United States Patent [19]

Fraden

[11] Patent Number: 4,479,329

[45] Date of Patent: Oct. 30, 1984

[54] TOY INCLUDING MOTION-DETECTING MEANS FOR ACTIVATING SAME

[76] Inventor: Jacob Fraden, 170 Lakeview Ave., Hamden, Conn. 06514

[21] Appl. No.: 307,235

[22] Filed: Sep. 30, 1981

[51] Int. Cl.[3] ..... A63H 33/26

[52] U.S. Cl. ..... 446/175; 446/219

[58] Field of Search ..... 46/45, 226, 227, 228, 46/232, 233, 264, 265, 266

[56] References Cited

U.S. PATENT DOCUMENTS

| | | | |
|---|---|---|---|
| 3,150,461 | 9/1964 | Grist | 46/232 |
| 3,274,729 | 9/1966 | Refabert | 46/232 |
| 3,350,098 | 10/1967 | Cromp et al. | 273/145 CA |
| 3,798,833 | 3/1974 | Campbell | 46/232 X |
| 3,867,786 | 2/1975 | Greenblatt | 46/264 X |
| 3,935,669 | 2/1976 | Potrzuski et al. | 46/232 X |
| 4,245,430 | 1/1981 | Hoyt | 46/228 X |
| 4,318,245 | 3/1982 | Stowell et al. | 46/232 |

FOREIGN PATENT DOCUMENTS

| | | | |
|---|---|---|---|
| 2045098 | 10/1980 | United Kingdom | 46/227 |

*Primary Examiner*—F. Barry Shay
*Attorney, Agent, or Firm*—Ilya Zborovsky

[57] ABSTRACT

A toy has a base member, a motion-detecting element mounted on the base member and detecting the presence of a motion of an object in the vicinity of the toy and the absence of a moving object in the vicinity of the toy, an action-performing element mounted on the base member for cooperating with the motion-detecting element, and electrical elements connecting the motion-detecting element and the action-performing element whereby the latter is operated in response to the detection by the motion-detecting element, wherein the motion-detecting element includes an objective arranged to transmit light to establish an image of an object in the vicinity of the toy, an image-distorting element located after the objective as considered in direction of light passage and arranged to distort the image, and a photosensing element arranged to sense the distorted image and produce a signal for operation of the action-performing element.

15 Claims, 7 Drawing Figures

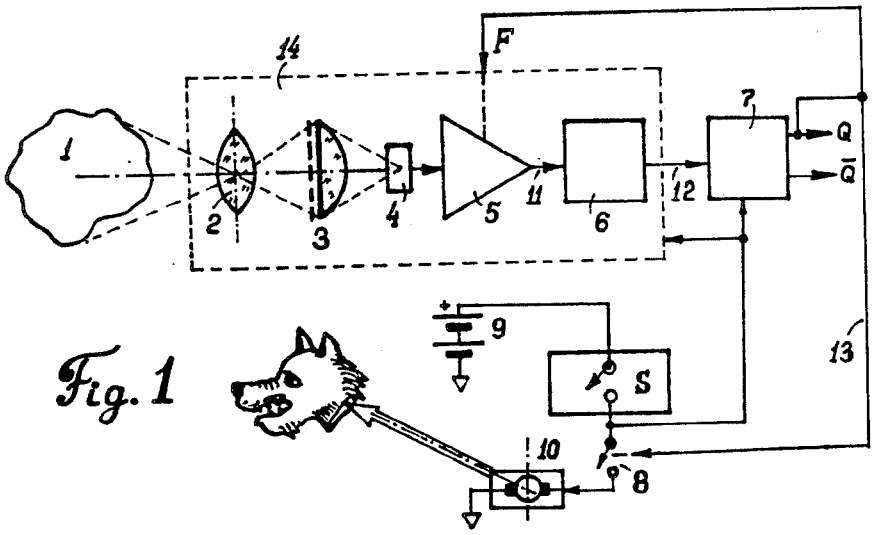
Fig. 1
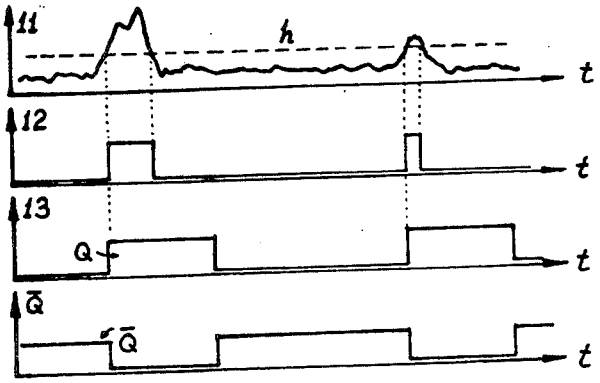
Fig. 2
Fig. 3
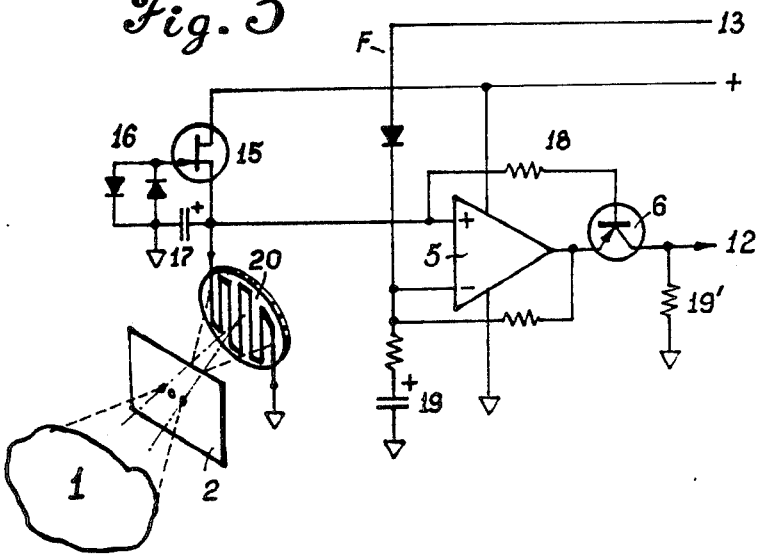

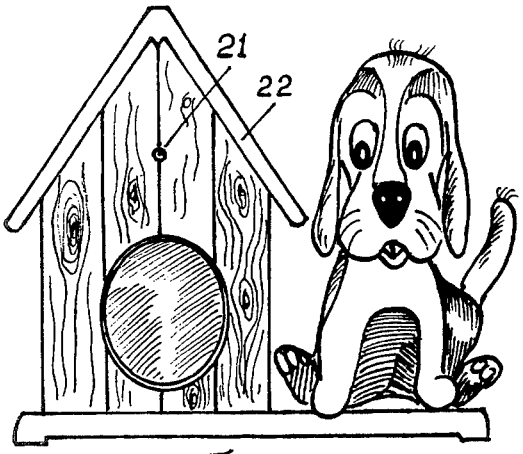
Fig. 4-a
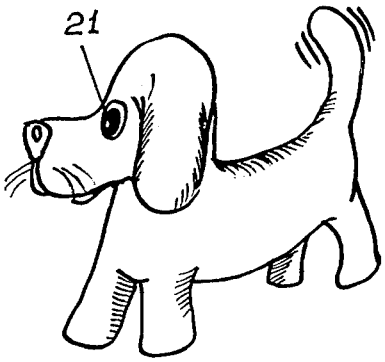
Fig. 4-b
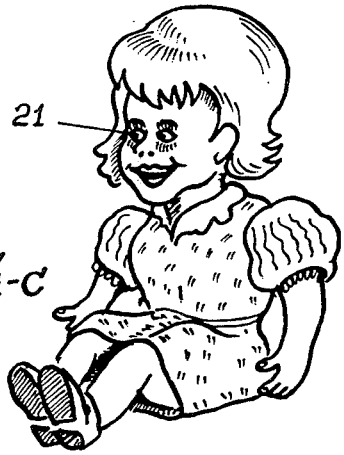
Fig. 4-c
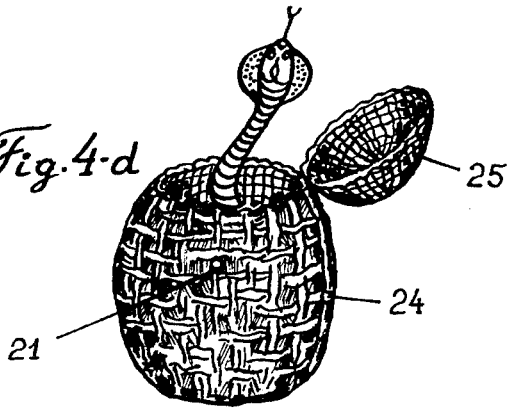
Fig. 4-d

TOY INCLUDING MOTION-DETECTING MEANS FOR ACTIVATING SAME

BACKGROUND OF THE INVENTION

The present invention relates to a toy, and particularly to an electric toy capable to act in different ways, e.g. to produce a mechanical motion, sounds, light etc.

Toys of the above mentioned general type are known in the art. Known toys operate when a playing person turns on a respective mechanism to produce the respective action from those listed above. There are, however, no toys which are controlled by a motion of a person or an object in the vicinity of the toy. Thus, it can be said that in this sence playing attractiveness of the known toys are limited.

SUMMARY OF THE INVENTION

Accordingly, it is an object of the present invention to provide a toy which avoids the disadvantages of the prior art.

More particularly, it is an object of the present invention to provide a toy with action or actions controlled by a motion of an object or person moving in the vicinity thereof.

In keeping with these objects and with others which will become apparent hereinafter, one feature of the present invention resides, briefly stated, in a toy which has motion detecting means arranged to detect the presence or absence of a motion of an object in the vicinity of the toy, and action performing means cooperating with the motion detecting means and arranged to operate in response to the detection performed by the motion detecting means.

When the toy designed in accordance with the present invention, its action is performed in response to the detection of a motion or the absence thereof. For example, a toy dog barks when he sees a stranger and stops barking when the stranger disappears, a toy doll cries when it does not see a girl and stops crying when the girl comes close to the doll, a fortress with guns fires when an enemy approaches and stops firing when the enemy retreats, a rattle snake appears from a basket when a child playing flute is present and hides in the basket when the child leaves the scene.

Thus, a mechanical motion, a generation of sounds, an emission of light of a toy can be controlled by a motion of a playing child or an object in the vicinity of the toy.

The novel features which are considered as characteristic for the present invention are set forth in particular in the appended claims. The invention itself, however, including its construction and mode of operation, will be best understood from the following description of preferred embodiments which is accompanied by the following drawings.

BRIEF DESCRIPTION OF THE DRAWINGS

FIG. 1 is a view showing an electrical circuit diagram of a motion-controlled toy in accordance with the present invention;

FIG. 2 is a view showing a voltage vs. time diagram of voltages available in the circuit of the inventive motion-controlled toy;

FIG. 3 is a schematic view of a motion detector of the inventive motion-controlled toy, including an amplifier and a threshold detector; and FIG. 4 shows perspective views of several preferred embodiments of fininshed motion-controlled toys in accordance with the present invention.

DESCRIPTION OF PREFERRED EMBODIMENTS

A toy in accordance with the present invention acts when an object moves or does not move in the vicinity of the toy, or more particularly, in a field of view which is identified by reference numeral 1.

The toy has a motion detector identified by reference numeral 14 and arranged to produce a signal 12 as long as a moving object is present in the field of view 1. A timer 7 is connected with the motion detector 14 and has outputs which are inverted relative to one another. The timer outputs are identified as Q and $\overline{Q}$. A respective one of the timer outputs, in the shown embodiment the output Q, is connected with a switch 8 operating for supplying power from a power source 9 or interrupting the power supply to an output mechanism 10.

When a toy is to act in response to a presence of a motion in the field of view, for example, a barking dog, and a child turns on an On/Off switch S being within the field of view, or a child enters the field of view after the switch S has been turned on earlier, the motion detector 14 generates pulses 12 indicating that the motion is detected.

The pulses 12 initiate starting input of the timer 7 with the above mentioned two outputs represented by two complementary voltages. A voltage 13 remains positive during the entire timing period, starting from the instant when the motion was detected. The voltage 13 keeps the switch 8 closed so as to provide power supply from the power source 9 to the output mechanism 10.

In the event when the mechanism 10 must be activated only if the motion is not detected, the reset input of the timer 7 is used for the command signal 12, and the inverted output $\overline{Q}$ supplies voltage for activation of the switch 8.

The output mechanism 10 can be formed as a mechanism producing a mechanical motion, generating a sound, emitting a light or providing a combination of the above mentioned action, etc. It is not limited to the above listed modes and can provide for any action required for each particular toy. Thus, in accordance with the described embodiment, the output mechanism of for example a barking dog acts in response to the motion detected in the field of view and the dog barks for a period of time determined by the timer. Upon expiration of this time and in condition of absence of a moving object in the field of view, the action of the output mechanism terminates and the dog stops barking.

In the second example when the toy must act in response to the absence of a moving object in the field of view, the switch 8 is closed only after the time determined by the timer has ellapsed. The output mechanism of the toy for example a doll acts when the dolls eyes do not see a playing child and the doll cries until somebody approaches her. In this case the timer must be reset by the signal 12 of the motion detector every time when the motion is detected.

Additional feedback F can further be provided from the timer 7, output voltage 13 to the motion detector. This feedback disables the motion detector while the output mechanism is operating. Otherwise, movements of the toy due to the mechanism 10 can reactivate the timer keeping the toy in a continuous operation. The feedback prevents appearance of the pulses 12 while the switch 8 is closed.

FIG. 2 presents a voltage 11 amplified at the output of an amplifier 5 of the motion detector 14. This voltage is originally produced by a photosensitive means 4 reacting to variations in illumination. FIG. 2 also illustrates the pulse or voltage 12 and the voltage 13.

The motion detector 14 includes an objective formed as an optical lens, pinhole aperture etc. When a moving object is present in the field of view 1, its image is created by the objective 2 on an image distortion means which forms a next part of the motion detector. Then the image is projected on the photosensitive means 4. The image distortion means 3 consists of a nonuniform surface and a condenser lens. Nonuniform surface can be formed, for example, as an opaque and transparent mask (grid). Any image created on this mask will be distorted. General illumination on the means 4 will depend on the motions in the image, because each moving part crossing the borders between the opaque and transparent lines on the mask will modulate illumination. A photodiode, photoresistor, or phototransistor can be used as the means 4. When the objective 2 is formed as a lens, it can be single, multiple, made of glass, plastic. The angle of view is between 45° and 90°.

The image distortion means may be formed not as a separate means similar to the means 3, but formed in a different way. For example, the photosensitive means 4 may have a nonuniform photosensitive surface thereby forming an image distortion means combined with the photosensitive means. An example of such means is a photoresistor 20, with wave-shaped sensor shown in FIG. 3. The motion detector finally includes the above mentioned amplifier 5 and an amplitude comparator 6.

FIG. 3 represents a preferable circuit diagram for the motion detector. A transistor Q1 identified by reference numeral 15 with diodes 16 and capacitor 17 establish operating current through a photosensor 20. The amplifier 5 is an AC amplifier whose gain and band width depends on a capacitor 19. The transistor 6 is an amplitude comparator having threshold of about 0.7 V, depending on base-emitter turn on voltage. As soon as the voltage between the input of the amplifier 5 and its output reaches the threshod voltage, the transistor 6 opens passing current through the resistor 19' and provides the output voltage 12.

As soon as the transistor 6 opens, current starts to pass across its base resistor 18 creating a positive feedback to the amplifier 5. This assures a rectangular output pulse. Therefore, a very simple circuit having just one operational amplifier and two transistors forms the sensitive motion detector. The timer 7 and switch 8 are conventional and therefore not described in detail.

FIG. 4 shows several examples of toys designed in accordance with the present invention.

FIG. 4*a* illustrates a watchdog. A power supply and motion detector 21 are accommodated in a kennel 22. The dog barks when anyone approaches the same. A puppy dog of FIG. 4*b* has the motion detector 21 in its eye and a power supply 23 in the belly. The dog barks and waves the tail when anyone approaches. In a doll shown in FIG. 4*c* the power supply is located inside and it is off when the doll is laying down. When the doll is up, her eyes open and motion detector is activated, identified by 21. The doll is silent when anyone moves nearby, but it cries when she does not see a playing child. There are two ways to stop her crying: to lay down or to play with her. Finally, a snake in a basket 24 of FIG. 4*d* does not move when the cover is closed, since the power is off. When the cover opens, the motion detector 21 is activated and the snake moves and hiss if it sees a playing person.

The invention is not limited to the details shown since various modifications and structural changes can be made without departing in any way from the spirit of the present invention. Different toys and modes of their operation may be provided within the basic idea of the present invention of reaction to the presence or absence of motion in the vicinity of the toy. The term "vicinity" is utilized here in a broad sence to define a distance which does not exceed the detection limit of the motion detecting means.

What is desired to be protected by Letters Patent is set forth in particular in the appended claims.

I claim:

1. A toy, comprising a base member;

motion-detecting means mounted on said base member, said motion-detecting means being constructed and arranged to detect at least one of the presence of a motion of an object in the vicinity of the toy and the absence of a moving object in the vicinity of the toy;

action-performing means mounted on said base member for cooperating with said motion-detecting means; and electrical means connecting said motion-detecting means and said action-producing means whereby the latter is operated in response to the detection by said motion-detecting means, said motion-detecting means including an objective arranged to transmit light to establish an image of an object in the vicinity of said toy, image-distorting means located after said objective as considered in direction of light passage and arranged to distort the image, and photosensing means arranged to sense the distorted image and produce a signal for operation of said action-performing means.

2. A toy as defined in claim 1, wherein said action-performing means is arranged to operate in response to the detection of the presence of motion by said motion-detecting means.

3. A toy as defined in claim 1, wherein said action-performing means is arranged to operate in response to the detection of the absence of motion by said motion-detecting means.

4. A toy as defined in claim 1; and further comprising timing means arranged to provide for the operation of said action-performing means during a predetermined period of time.

5. A toy as defined in claim 1, wherein said image-distorting means is means separate from said photosensing means and includes a plurality of alternating transparent and opaque bands.

6. A toy as defined in claim 1, wherein said photosensing means includes a non-uniform photosensing surface forming said image-distorting means combined with said photosensing means.

7. A toy as defined in claim 1, wherein said objective includes at least one optical lens.

8. A toy as defined in claim 1, wherein said objective includes at least one pinhole aperture.

9. A toy as defined in claim 1, wherein said action-performing means is means for performing a mechanical motion in response to the detection by said motion-detecting means.

10. A toy as defined in claim 1, wherein said action-performing means is means for producing a sound in response to the detection by said motion-detecting means.

11. A toy as defined in claim 1, wherein said action-performing means is means for producing a light in response to the detection by said motion-detecting means.

12. A toy as defined in claim 1, wherein said action-performing means is means for performing a mechanical motion and simultaneously producing a sound in responce to the detection by said motion-detecting means.

13. A toy as defined in claim 1, wherein said action-performing means is means for producing a sound and a light in response to the detection by said motion-detecting means.

14. A toy as defined in claim 1, wherein said action-performing means is means for producing a light and performing a mechanical action in response to the detection by said motion-detecting means.

15. A toy as defined in claim 4; and further comprising a feedback circuit from the output of said timing means to at least one input of said motion-detecting means to disable the latter during said predetermined period of time.

* * * * *